US008157141B2

(12) United States Patent
McDonald et al.

(10) Patent No.: US 8,157,141 B2
(45) Date of Patent: Apr. 17, 2012

(54) SYSTEM AND METHOD FOR DETECTING AND REGISTERING SERRATED BAGS

(75) Inventors: Greg McDonald, Simpsonville, SC (US); Darren Mungo, Greer, SC (US); Wayne Workman, Duncan, SC (US)

(73) Assignee: Cryovac, Inc., Duncan, SC (US)

( * ) Notice: Subject to any disclaimer, the term of this patent is extended or adjusted under 35 U.S.C. 154(b) by 1085 days.

(21) Appl. No.: 11/452,667

(22) Filed: Jun. 14, 2006

(65) Prior Publication Data

US 2008/0002920 A1 Jan. 3, 2008

(51) Int. Cl.
*B26F 3/02* (2006.01)

(52) U.S. Cl. ..... 225/100; 83/371

(58) Field of Classification Search ..... 225/93, 225/100; 83/169, 402, 371; 53/64, 66, 67, 53/571

See application file for complete search history.

(56) References Cited

U.S. PATENT DOCUMENTS

| | | | | |
|---|---|---|---|---|
| 2,760,290 A | | 8/1956 | Miller et al. | |
| 2,838,303 A | | 6/1958 | Morley | |
| 2,936,815 A | * | 5/1960 | Schjeldahl et al. | 156/353 |
| 2,958,437 A | * | 11/1960 | Mengis | 156/519 |
| 3,115,037 A | | 12/1963 | Forrester | |
| 3,123,268 A | * | 3/1964 | Gagg | 226/111 |
| 3,125,266 A | * | 3/1964 | Kindseth et al. | 226/43 |
| 3,161,347 A | * | 12/1964 | Hannon | 229/69 |
| 3,194,055 A | | 7/1965 | Knobel | |
| 3,201,985 A | | 8/1965 | Williams | |
| 3,254,828 A | * | 6/1966 | Lerner | 383/37 |
| 3,475,956 A | | 11/1969 | Langlois et al. | |
| 3,567,091 A | * | 3/1971 | Woolard | 226/18 |
| 3,675,542 A | * | 7/1972 | Torigoe | 493/194 |
| 3,727,817 A | | 4/1973 | Tibavido | |
| 3,741,079 A | * | 6/1973 | Bossons et al. | 493/350 |
| 3,754,370 A | * | 8/1973 | Hanson | 53/459 |
| 3,837,549 A | | 9/1974 | Sengawald | |
| 4,261,497 A | * | 4/1981 | Roetter et al. | 225/100 |
| 4,264,317 A | * | 4/1981 | Feldkamper | 493/213 |
| 4,300,892 A | | 11/1981 | Barnes et al. | |

(Continued)

FOREIGN PATENT DOCUMENTS

EP 716036 A1 * 6/1996

(Continued)

OTHER PUBLICATIONS

"Model BL135", 2 page brochure, undated.

(Continued)

*Primary Examiner* — Kenneth E. Peterson
*Assistant Examiner* — Jennifer Swinney
(74) *Attorney, Agent, or Firm* — Mark B. Quatt

(57) ABSTRACT

A system for detecting and registering serrated bags includes a web including a plurality of bags connected in an end-to-end arrangement, each bag including a first and second side, a first and second longitudinal end, a transverse seal, a serration disposed transversely across the bag, and a tab integrally connected to the bag at a portion of but less than the entire extent of the tab; a device for projecting a stream of air on each bag as the web passes a predetermined location; and a first and a second pair of nip rolls, each disposed downstream of the device, and adapted to accommodate the web, and to drive at different speeds such that a lead bag is separated from the web.

3 Claims, 8 Drawing Sheets

U.S. PATENT DOCUMENTS 4,336,681 A * 6/1982 Onishi ..... 53/459
4,383,435 A 5/1983 Hinzmann
4,651,506 A * 3/1987 Lerner et al. ..... 53/459
4,694,638 A * 9/1987 Maddux et al. ..... 53/459
4,704,101 A 11/1987 Schirmer
4,770,731 A 9/1988 Ferguson
4,785,696 A * 11/1988 Martiny ..... 83/152
4,831,926 A 5/1989 Bowman et al.
4,969,360 A * 11/1990 Dougall ..... 73/521
5,020,922 A 6/1991 Schirmer
5,045,134 A * 9/1991 Schenker et al. ..... 156/64
5,052,233 A 10/1991 Rantala
5,064,408 A * 11/1991 Bridgeman ..... 493/194
5,094,708 A * 3/1992 Bechtel et al. ..... 156/351
5,135,146 A 8/1992 Simhaee
5,141,142 A * 8/1992 Ramsey ..... 225/4
5,176,371 A 1/1993 Rau et al.
5,205,053 A * 4/1993 Brunner ..... 34/620
5,219,424 A 6/1993 Simhaee
5,261,585 A 11/1993 Simhaee
5,376,394 A 12/1994 Dudenhoeffer et al.
5,534,276 A * 7/1996 Ennis ..... 426/127
5,545,419 A 8/1996 Brady et al.
5,556,019 A 9/1996 Morris
5,558,262 A 9/1996 Simhaee
5,573,168 A 11/1996 Kannankeril et al.
5,702,739 A 12/1997 Owensby
5,813,585 A 9/1998 Kannankeril et al.
5,921,390 A 7/1999 Simhaee
5,934,535 A 8/1999 Kannankeril et al.
6,021,624 A * 2/2000 Richison et al. ..... 53/410
6,135,281 A 10/2000 Simhaee
6,171,627 B1 1/2001 Bert et al.
6,173,992 B1 * 1/2001 Manico et al. ..... 283/67
6,183,132 B1 2/2001 Simhaee
6,206,569 B1 3/2001 Kraimer et al.
6,228,446 B1 5/2001 Moffitt
6,254,909 B1 7/2001 Williams et al.
6,270,819 B1 8/2001 Wiese
6,287,613 B1 9/2001 Childress et al.
6,296,886 B1 10/2001 DePoorter et al.
6,325,615 B1 12/2001 Johnson et al.
6,381,919 B2 * 5/2002 Todd et al. ..... 53/64
6,383,537 B1 5/2002 Brady et al.
6,488,222 B1 12/2002 West et al.
6,561,403 B1 5/2003 Kannankeril et al.
6,562,171 B1 * 5/2003 Archie et al. ..... 156/204
6,663,905 B1 12/2003 Ennis et al.
6,685,075 B1 2/2004 Kannankeril
6,749,910 B1 6/2004 Georgelos et al.
6,777,047 B1 8/2004 Tatarka et al.
6,790,468 B1 9/2004 Mize, Jr. et al.
6,837,023 B1 * 1/2005 Glatfelter, Jr. ..... 53/64
6,884,480 B2 4/2005 Bradfute et al.
6,929,132 B2 * 8/2005 Belt ..... 211/113
6,948,296 B1 * 9/2005 Lerner et al. ..... 53/476
6,993,885 B2 * 2/2006 Glatfelter, Jr. ..... 53/411
7,125,463 B2 * 10/2006 Lerner et al. ..... 156/145
7,607,467 B2 * 10/2009 McDonald et al. ..... 156/510
2003/0021870 A1 1/2003 Pollok et al.
2003/0053720 A1 * 3/2003 Smith et al. ..... 383/35
2003/0175390 A1 9/2003 Oberle
2004/0000572 A1 * 1/2004 Engelhardt et al. ..... 225/1
2004/0118735 A1 6/2004 Mize et al.
2004/0211807 A1 * 10/2004 Kolbe et al. ..... 225/100
2007/0241160 A1 * 10/2007 Kenney ..... 225/100

FOREIGN PATENT DOCUMENTS

EP 1 095 765 5/2001
EP 1 095 874 5/2001
EP 1273254 A2 * 1/2003
JP 61194220 A * 8/1986
JP 02282054 A * 11/1990
JP 06134699 A * 5/1994
JP 2004212422 A * 7/2004
WO 98/45187 10/1998

OTHER PUBLICATIONS

"Main Assembly BL135", one page drawing, Nov. 16, 2004.

* cited by examiner

SYSTEM AND METHOD FOR DETECTING AND REGISTERING SERRATED BAGS

FIELD OF THE INVENTION

The present invention relates to a system and method for detecting and registering serrated bags. The present invention also relates to a roll of serrated bags with a tab in each bag.

BACKGROUND OF THE INVENTION

Many packaging applications, especially food packaging, require or benefit from the use of bags made from various thermoplastic materials and structures.

These bags are commonly used in large scale meat processing and/or packaging systems where production speed and efficiency are important. Bags to be used in these systems can be provided in a roll, with adjoining bags connected by a transverse line of serrations or perforations.

At the loading station of a conventional system, each bag can be opened and then loaded with an article such as a fresh red meat subprimal or smoked and processed meat, poultry, cheese, or other perishable food product, or other product.

Where rolls of serrated bags are employed, it is beneficial to provide a way of dispensing each bag an appropriate distance as it feeds from the selected roll.

One way of accomplishing this is the use of a pre-printed registration mark on each bag.

One disadvantage of using printed registration marks is that an additional operation is required in manufacturing the roll of serrated bags. The printed registration marks must be printed in sequential fashion on each of the series of bags. This would add cost to the roll of bags, and would increase the process time in producing such bags. Also, bags are sometimes printed "on site" i.e. at the location where the bags are sequentially dispensed and loaded with a meat or other product. Pre-printing registration marks on each bag, and then printing additional indicia or codes on each bag at the location where the bags are processed and loaded, is inefficient.

One method of registering rolled serrated bags without the use of print marks, has been the use of a "speed bump" device. As a web of bags is advanced from the roll of serrated bags, this device takes advantage of the fact that a seal on each bag is thicker than the unsealed film on either side of the seal. Each seal can be sensed by the rotary displacement of a lever arm around a pivot point due to the action of each seal displacing a roller away from a fixed member, as the web of bags is advanced across the fixed member. Sensing the motion of the lever arm is accomplished with a proximity switch. A registration signal is generated as each seal passes the fixed point.

Unfortunately, this method would not be consistently reliable if patch bags were to be used in the packaging process. Patch bags, for example those supplied by Sealed Air Corporation under the trademark TBG™, include a seal in the primary bag material, but also a patch on at least a portion of at least one ply of the bag. Patch bags, and methods of making them, are described in U.S. Pat. No. 4,770,731 (Ferguson), U.S. Pat. No. 6,287,613 (Childress et al.), U.S. Pat. No. 6,383,537 (Brady et al.), U.S. Pat. No. 6,254,909 (Williams et al.), U.S. Pat. No. 5,545,419 (Brady et al.), U.S. Pat. No. 6,270,819 (Wiese), U.S. Pat. No. 6,790,468 (Mize et al.), U.S. Pat. No. 6,663,905 (Ennis et al.), U.S. Pat. No. 6,296,886 (DePoorter et al.), U.S. Pat. No. 5,534,276 (Ennis), U.S. Pat. No. 4,704,101 (Schirmer), U.S. Pat. No. 5,020,922 (Schirmer), U.S. Pat. No. 6,228,446 (Moffitt), U.S. Pat. No. 6,884,480 (Bradfute et al.), U.S. Pat. No. 5,376,394 (Dudenhoeffer et al.), U.S. Pat. No. 6,171,627 (Bert et al.), U.S. Pat. No. 6,206,569 (Kraimer et al.), U.S. Pat. No. 6,749,910 (Georgelos et al.), and U.S. Pat. No. 6,777,047 (Tatarka et al.); US Patent Application Publication Nos. US 2003/0175390 (Oberle), 2003/0021870 (Pollok et al.), and 2004/0118735 (Mize et al.); and EP 1095765 A2 (Cryovac, Inc.), EP 1095874 A2 (Cryovac, Inc.), and WO 98/45187 (Cryovac, Inc.); all of the above incorporated herein by reference in their entirety.

The patch of a patch bag would result in a raised portion of the bag in the area of the patch. The configuration of the bag would be such that the "speed bump" methodology could not be totally relied on, because the sensor may variously be reacting to e.g. the bag seal, the front (downstream) end of the patch located on the bag, or the rear (upstream) end of the patch located on the bag, depending on the particular patch bag configuration.

It is therefore desirable to provide a system and method for sensing and registering serrated bags drawn sequentially from a roll, or otherwise provided sequentially, that does not rely on pre-printed registration marks, or on a device that detects the seal area of each bag in a series of bags by displacement of a lever arm.

SUMMARY OF THE INVENTION

In a first aspect, a system for detecting and registering serrated bags comprises a web comprising a plurality of bags, the bags connected in an end-to-end arrangement, each bag of the plurality of bags comprising a first side, a second side, a first longitudinal end, a second longitudinal end, a transverse seal, a serration disposed transversely across the bag and extending from the first side to the second side, and a tab disposed intermediate the first and second sides, and intermediate the first longitudinal end and second longitudinal end, the tab integrally connected to the bag at a portion of but less than the entire extent of the tab; a device for projecting a stream of air on each bag as the web passes a predetermined location; a first pair of nip rolls disposed downstream of the device; and a second pair of nip rolls disposed downstream of the first pair of nip rolls; wherein the first and second pair of nip rolls are adapted to accommodate the web, and to drive at different speeds such that a lead bag is separated from the web.

In a second aspect, a method of detecting and registering serrated bags comprises providing a web comprising a plurality of bags, the bags connected in an end-to-end arrangement, each bag of the plurality of bags comprising a first side, a second side, a first longitudinal end, a second longitudinal end, a transverse seal, a serration disposed transversely across the bag and extending from the first side to the second side, and a tab disposed intermediate the first and second sides, and intermediate the first longitudinal end and second longitudinal end, the tab integrally connected to the bag at a portion of but less than the entire extent of the tab; advancing the web passed a device for projecting a stream of air on each bag as the web passes a predetermined location; projecting a stream of air on each bag as the web passes the predetermined location; drawing the web between a first and second pair of nip rolls; and stopping the first pair of nip rolls while rotating the second pair of nip rolls, such that a lead bag is separated from the web.

In a third aspect, an article of manufacture comprises a roll of serrated bags, the bags connected in an end-to-end arrangement, each bag comprising a first side, a second side, a first longitudinal end, a second longitudinal end, a transverse seal, a serration disposed transversely across the bag and extending from the first side to the second side, and a tab disposed intermediate the first and second sides, and intermediate the first longitudinal end and second longitudinal end, the tab integrally connected to the bag at a portion of but less than the entire extent of the tab; wherein the tab is spaced apart from, and not connected to, the serration.

BRIEF DESCRIPTION OF THE DRAWINGS

In the drawings presented by way of illustration of the invention.

DETAILED DESCRIPTION OF THE INVENTION

Figure 1:
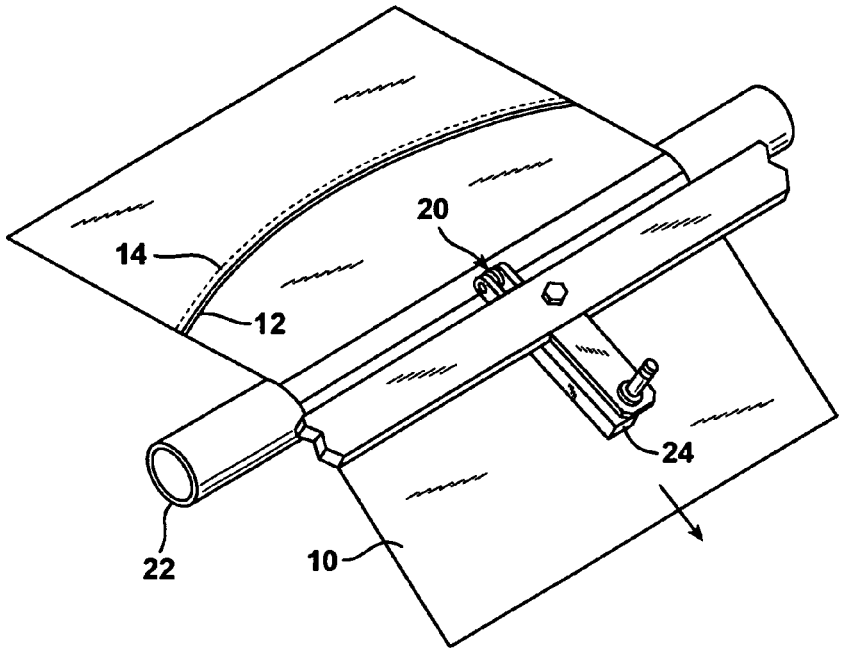
FIG. 1 PRIOR ART
FIG. 1 is a perspective view of a prior art apparatus for detecting and registering roll serrated bags.

"Web" herein refers to a leading portion of a plurality of serrated bags in which the leading portion is advanced to interface with the system of the invention and undergo one or more of the operations disclosed herein. Serrated bags per se are well known in the art. Serrated bags are typically in roll form, with adjacent bags attached by means of a set of perforations running transversely across the bags. These serrations allow each leading bag to be separated from the web of bags as needed. Serrated bags each include a transverse seal at or near one end of the bag.

"Serration", "serrated" and the like herein refers to perforations, serrations, laser scoring, etc. that connect adjacent bags in a web or train of bags such that adjacent bags can be separated relatively easily along the line of the serration by manual or mechanical means. The serration can be made up of a plurality of holes extended in a straight or curved line across the respective bag, and extending through both plies or walls of the bag. In embodiments where the bags are patch bags, the serration will typically be present in a part of each bag where the patch is not present. Individual holes in the serration can be of any suitable size and geometry, and can be identical to one another or different from one another in dimension or geometry. The spaces between adjacent individual holes in the serration can all be of the same length, or alternatively the spaces between adjacent individual holes in the serration can differ in length.

"Tab" herein refers to a flap or piece of a bag, where at least one cut has been made in the bag to provide an opening through which a stream of air can pass for purposes described herein. The tab can have any suitable geometry, size, and location on each bag. At least a portion of the tab, when manufactured, will remain integrally attached to the bag. "Integrally", because the tab is effectively a partially disconnected part of the bag. The cut is a through-cut, i.e. cut through both plies or walls of the bag. At least a portion of the tab will be formed by one or more cuts in the bag. More than one tab can be used in each bag. The tab or tabs are beneficially configured and placed such that it or they function cooperatively with the other elements of the invention, as described herein, to detect and register serrated bags.

"Registration" and the like herein refers to establishing the location of a bag relative to the equipment system through which the bag is positioned or advanced. Establishing the location of the features of the bag, e.g. the serration and the tab or tabs relative to the equipment system, using the present invention, in turn establishes the location of the bag itself within the equipment system.

The embodiments disclosed herein are directed primarily to rolled serrated bags, i.e. a plurality of serrated bags wound up on a roll, from which a web can be dispensed or advanced. Those skilled in the art will understand, after a review of the present disclosure, that the present invention can be beneficially used with alternative methods and systems for supplying serrated bags. For example, the serrated bags can be stored in a stacked fashion in a box, and pulled out of the box as needed.

Also, while the invention finds particular benefit in embodiments where the serrated bags are patch bags, the invention can be used with benefit in embodiments where the serrated bags are not patch bags.

Figure 2:
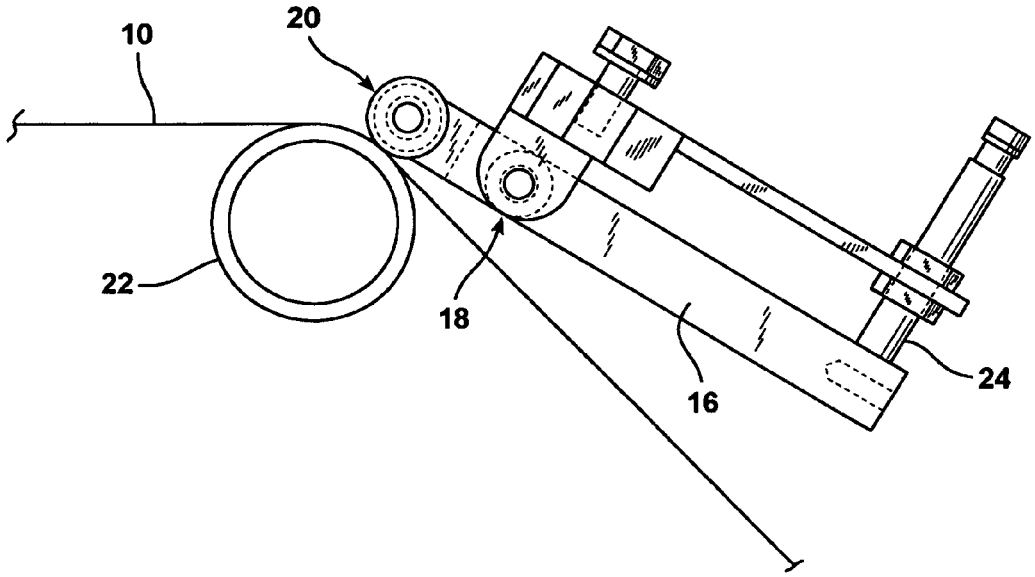
FIG. 2 PRIOR ART
FIG. 2 is a front view of the apparatus of FIG. 1.

Referring to FIGS. 1 and 2, directed to a prior art system for detecting and registering roll serrated bags, each bag 10 in a roll of serrated bags includes a seal 12 and a serration 14 adjacent seal 12. Seal 12 has a greater thickness than the unsealed film around it. As shown in FIGS. 1 and 2, the machine direction, i.e. the path of travel of the bags, is such that for each bag, the seal 12 precedes the serration 14; that is, the seal is positioned downstream of the respective serration. Bag registration for further machine processes, such as printing, and/or separation of a bag from the next sequential bag in the series of bags, is accomplished by sensing the rotary displacement of lever arm 16 around pivot point 18 due to the action of seal 12 displacing roller 20 away from fixed member 22 as the seal 12 passes over fixed member 22. Sensing the motion of lever arm 16 is done by proximity switch 24, or other suitable motion detection device. A registration signal is thus generated as each seal passes a fixed point. This signal is used to activate a set of downstream rollers to pull and separate the leading bag from the web. The thus separated bag is then arranged, manually or mechanically, so that a meat cut or other product can be loaded into the separated bag.

As indicated above, this method would not be consistently reliable if patch bags were to be used in the packaging process. Patch bags include a seal in the primary bag material, but also a patch on at least one ply of the bag. This patch will typically result in a raised portion of the bag in the area of the patch. The configuration of the bag would be such that because the sensor may variously be reacting to the bag seal, the front (downstream) end of the patch located on the bag, or the rear (upstream) end of the patch located on the bag, a "false" signal could be received by the sensor. Methods could be developed to discriminate between the rise caused by the seal, and a rise caused by the passage of the patch portion of the bag. Such methods however would likely be complex and expensive to produce and operate, and not necessarily reliable. A highly useful system should also be able to accommodate both patch bags and bags without a patch (i.e. patchless bags).

In accordance with the invention, and referring to FIGS. 3 to 7, each bag 110 in a series of serrated bags includes a seal 112, which can be straight or curved, and a serration 114 adjacent seal 112. The serration is beneficially spaced from seal 112 for ease of manufacturing the bags. As shown in the drawings, the machine direction, i.e. the path of travel of the bags, is such that the seal 112 precedes the serration 114; that is, the seal is positioned downstream of the serration. The serration is shown as parallel to the seal, but the serration in some embodiments need not be strictly parallel to the seal.

Figure 3:
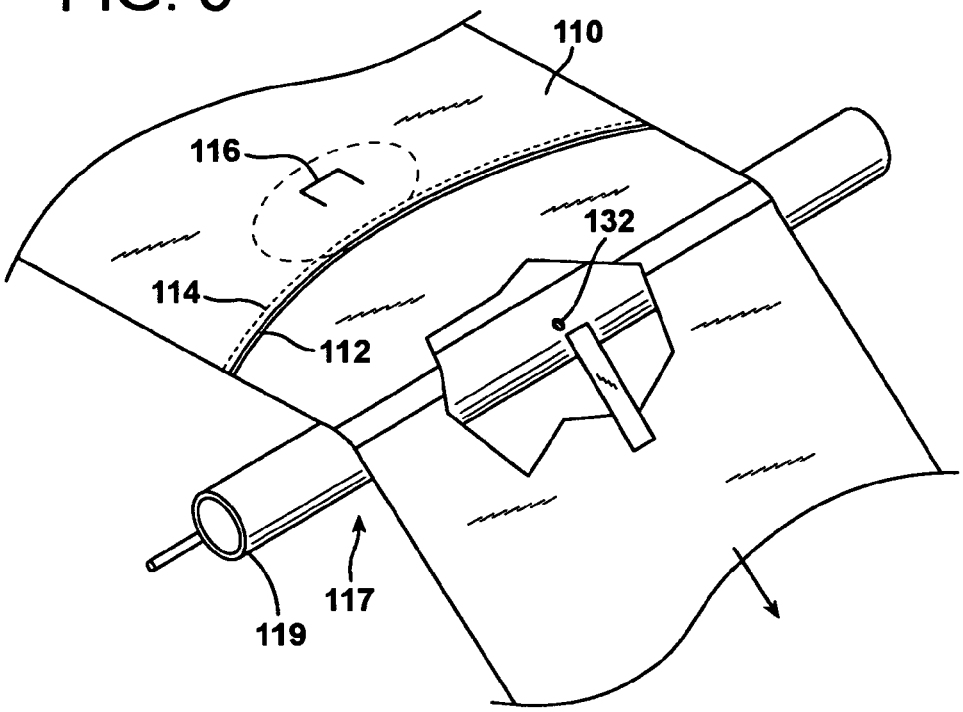
FIG. 3 is a perspective view of an apparatus for detecting and registering roll serrated bags in accordance with the present invention.
Figure 4:
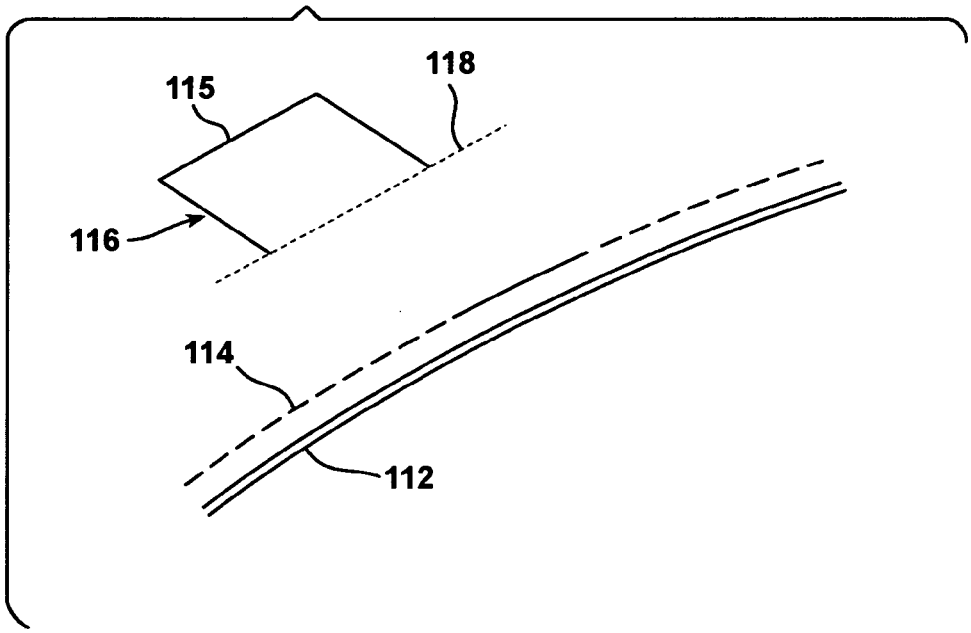
FIG. 4 is a perspective enlarged view of the encircled portion of FIG. 1.
Figure 5:
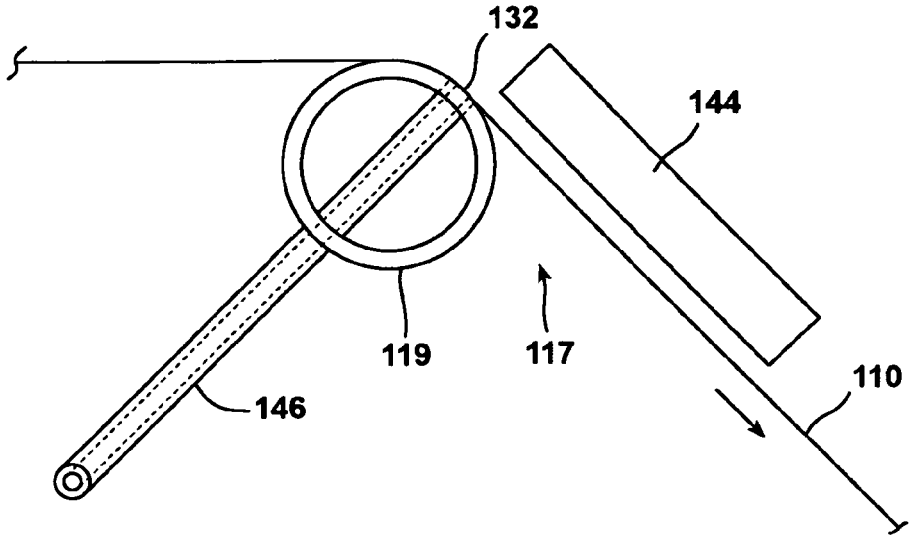
FIG. 5 is a front view of the device of FIG. 3.
Figure 6:
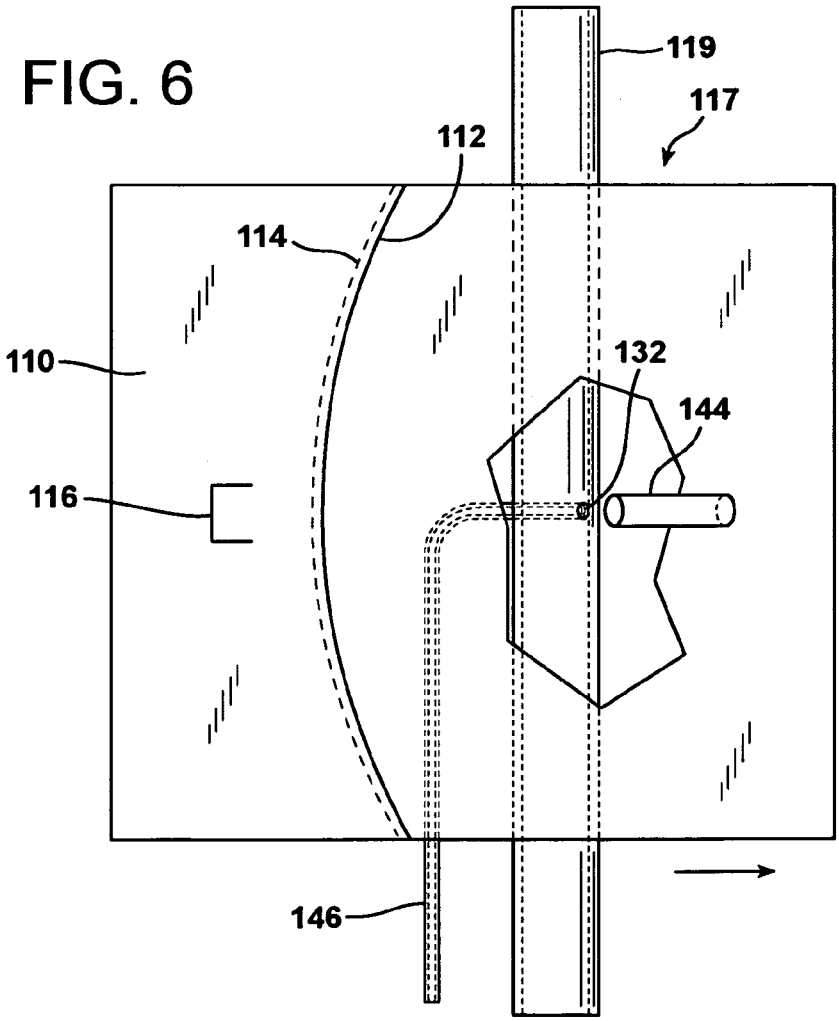
FIG. 6 is a plan view of the device of FIG. 3.
Figure 7:
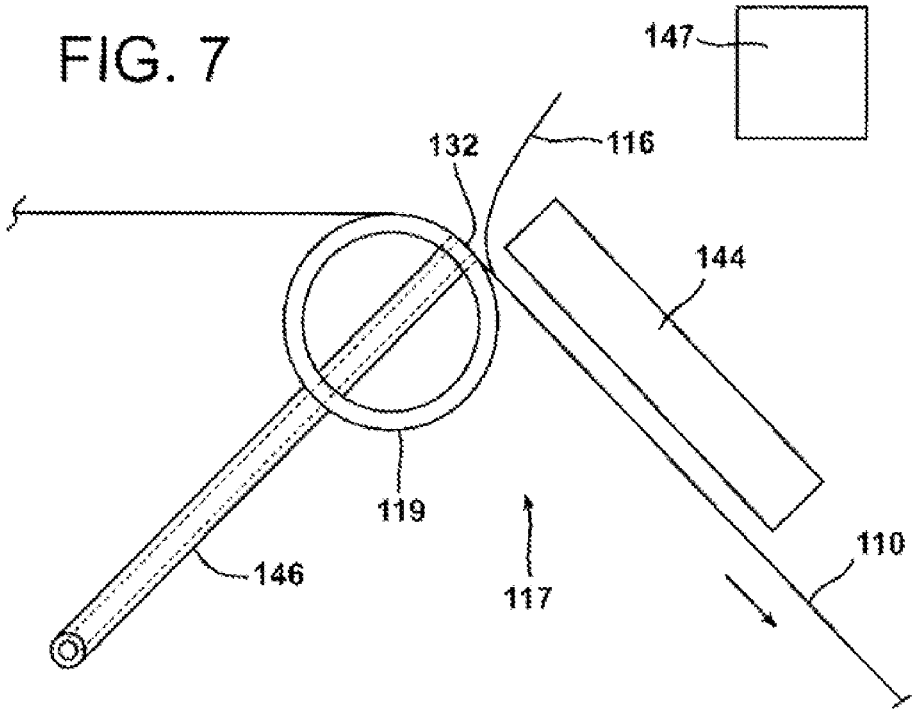
FIG. 7 is a front view of the device of FIG. 3 after a tab has reached a proximity switch in accordance with one embodiment of the invention.

As shown in FIGS. 3 and 4, bag 110 is constructed with a through cut that forms a tab 116, which hinges on an uncut portion of bag 110 designated by reference line 118. The tab of the invention is configured such that it will function, along with the other components of the inventive system and method, to provide a detectable pressure drop that can be used to register a plurality of serrated bags as they are dispensed from a web of serrated bags, e.g. a roll of serrated bags.

Sensing device 117 (FIGS. 3, 5, 6, and 7) includes an air line 146 supplied by any suitable and conventional source of compressed air. An exit end 132 of air line 146 directs a stream of air against bag 110 of the web, as the web passes over fixed roller 119. Fixed roller 119 can in one embodiment have a curved geometry or radius across the width of the roller to provide better tracking of the web as it passes over the fixed roller 119.

In one embodiment, as the tab 116 passes over the exit end 132 of air line 146, a drop in air pressure can be detected by a suitable and conventional detection device 147. An example of such a device would be an electronic pressure to electrical current (or voltage) transducer. A signal can then be sent to the downstream nip rollers discussed further herein to initiate separation of a lead bag from the web.

In another embodiment, the tab 116 can alternatively or additionally be raised from the plane of the bag by a stream of air exiting from the air line 146 of detecting device 117. This occurs as the portion of the bag having the tab 116 passes over the exit end 132 of device 117. Thus, bag registration for further machine processes, such as printing, and/or separation of a bag from the next sequential bag in the series of bags, can be accomplished by sensing the tab 116 with proximity switch 144 as the tab passes over the exit end 132 of air line 146. A registration signal is thus generated, activating downstream nip rolls as described herein. The tab 116 is sensed because the air pressure from air line 146 forces the tab above the plane of the bag 110, where the tab can be sensed by the proximity switch 144.

The invention provides a method of registering a web of serrated bags, such as serrated bags dispensed from a roll, without the use of printed registration marks, or displacement of a lever arm or similar device, to detect the presence or position of a serrated bag in a bag dispensing system.

Although the tab 116 and reference line 118 are shown as rectangular, any suitable geometry can be employed.

Figure 8:
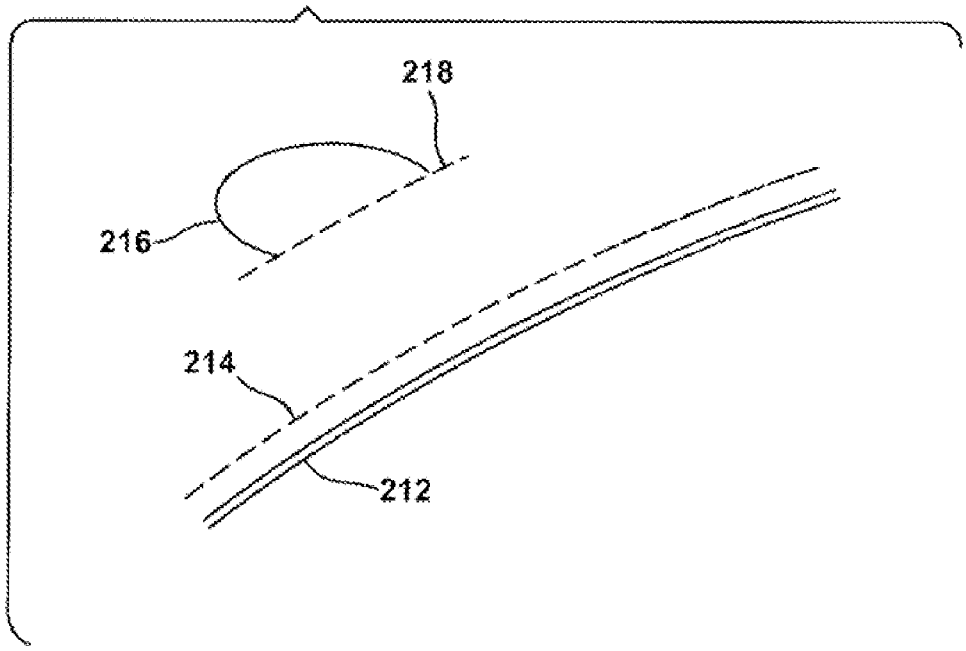
FIG. 8 is a perspective enlarged view of an alternative embodiment of the invention.

By way of example, in FIG. 8 a tab 216 and reference line 218 are shown, installed on a bag having seal 212 and serration 214, in which the tab has an oval geometry.

Figure 9:
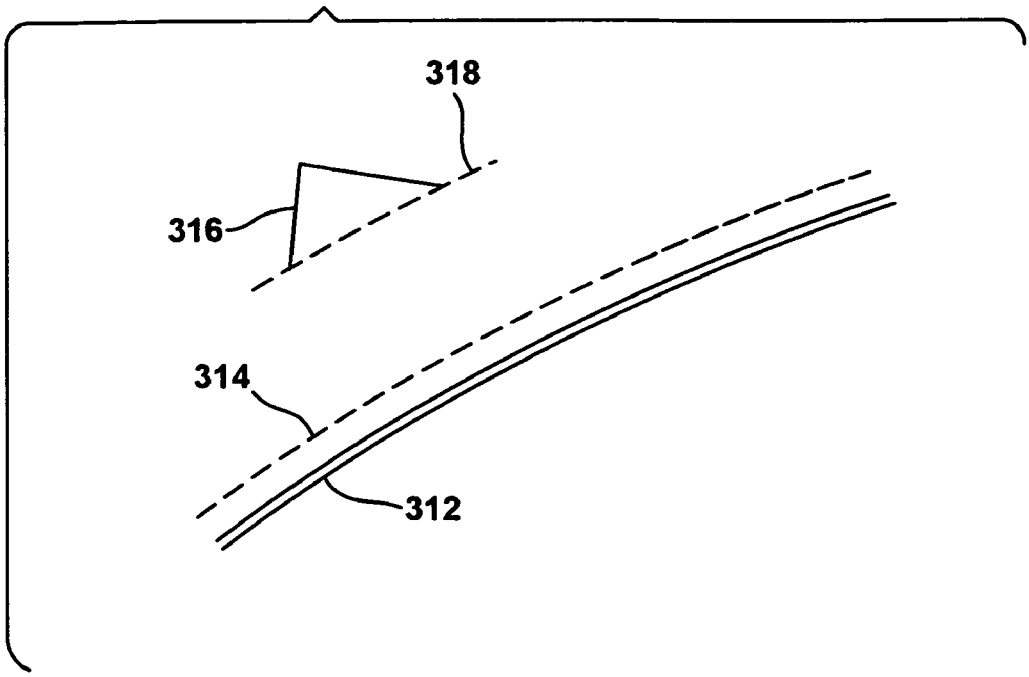
FIG. 9 is a perspective enlarged view of another alternative embodiment of the invention.

In FIG. 9, a tab 316 and reference line 318 are shown, installed on a bag having seal 312 and serration 314 in a manner similar to that of the embodiments of FIGS. 4 and 8, but in which the tab 316 is substantially triangular.

Figure 10:
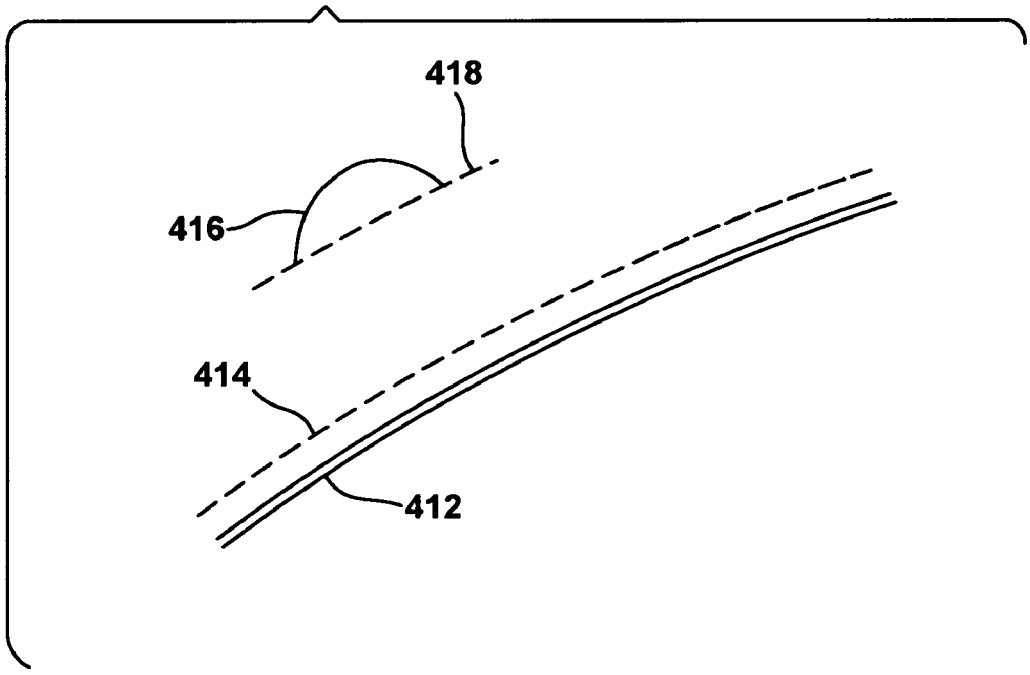
FIG. 10 is a perspective enlarged view of yet another alternative embodiment of the invention.

In FIG. 10, a tab 416 and reference line 418 are shown, installed on a bag having seal 412 and serration 414 in a manner similar to that of the embodiments of FIGS. 4, 8 and 9, but in which the tab 416 is substantially arcuate, e.g. hemispherical.

Figure 11:
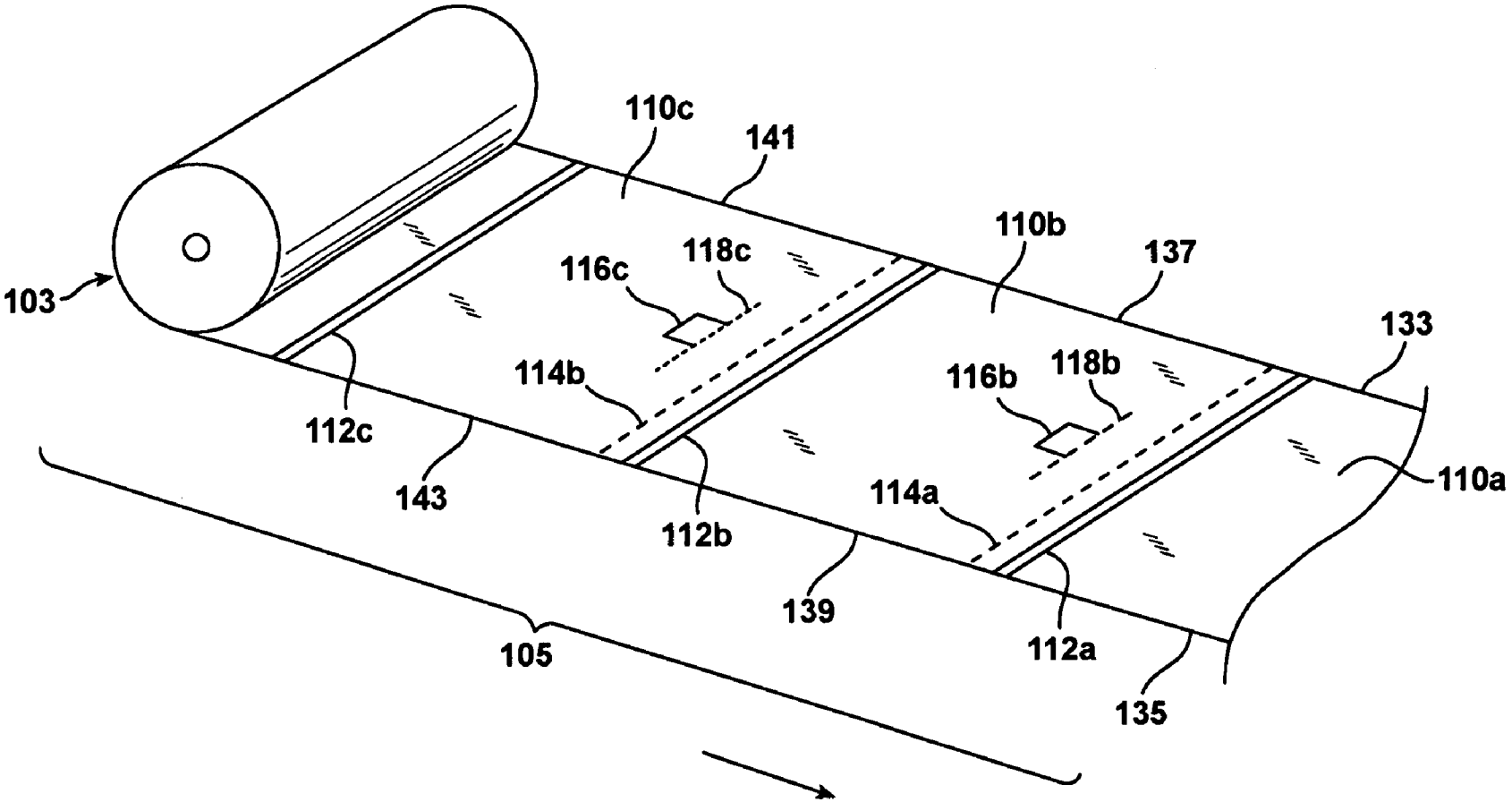
FIG. 11 is a perspective view of a roll of serrated bags with a web in accordance with the invention.

FIG. 11 discloses a roll 103 of serrated bags with a web in accordance with one embodiment of the invention. Web 105 is a leading portion of a plurality of serrated bags drawn from roll 103. A portion of a leading bag 110*a* is shown toward the right side of the drawing. This leading bag can be separated from the web 105 in accordance with the invention by downstream operations described herein. Bag 110*a* has a transverse seal 112*a*. Bag seals are in general heat seals, although any suitable seal can be used in accordance with the invention. Although bags in accordance with the invention are beneficially end seal bags, the invention can be used in connection with side seal bags. Thus, the first side 133 and second side 135 of bag 110*a* are, in the case of end seal bags, each made up of a bag fold. The bag upstream and adjacent to bag 110*a* is bag 110*b*, similarly configured with transverse seal 112*b*, and first side 137 and second side 139. Bag 110*b* also has a serration 114*a*, a tab 116*b*, and a reference line 118*b* indicating the line of attachment of tab 116*b* to bag 110*b*. The bag upstream and adjacent to bag 110*b* is bag 110*c*, similarly configured with transverse seal 112*c*, and first side 141 and second side 143. Bag 110*c* also has a serration, tab, and reference line (not shown).

The invention can be beneficially used with a variety of bag types, including patch bags, and bags without patches. Any films, especially thermoplastic films such as olefinic films with or without oxygen barrier functionality, can be used with benefit in making or providing bags, including patch bags, in connection with the invention. These films are made by extrusion coating, coextrusion, lamination, or other suitable processes. In one embodiment, films comprise an outer layer, an intermediate layer, and an inner layer. The materials of the outer layer are often chosen for abuse resistance and/or sealability, and can be chosen from any suitable polymeric materials such as polyolefins, such as ethylenic polymers and copolymers, polypropylene, polyesters, polyamides, and the like. The inner layer materials, often chosen for sealability, can be any of the materials described for the outer layer. The intermediate layer materials are often chosen for their barrier qualities (i.e. barriers to oxygen, moisture, carbon dioxide, etc.). Suitable materials include polyvinylidene chloride polymers and copolymers, ethylene vinyl alcohol copolymer, polyvinyl alcohol, polyamide, polyester, acrylonitrile, and the like. Bags can be heat shrinkable, and can be at least partially crosslinked.

The films described herein can be used for the bag itself, for the patch attached to the bag, or both, in any suitable thickness and layer arrangement. The tab can be installed in the patch area of a patch bag, but would typically be installed in an area of the bag not covered by the patch, so as not to compromise the bag integrity after the bag has been separated from the web of bags, and after a food or other product has been loaded in the bag.

EXAMPLE 1

Figure 12:
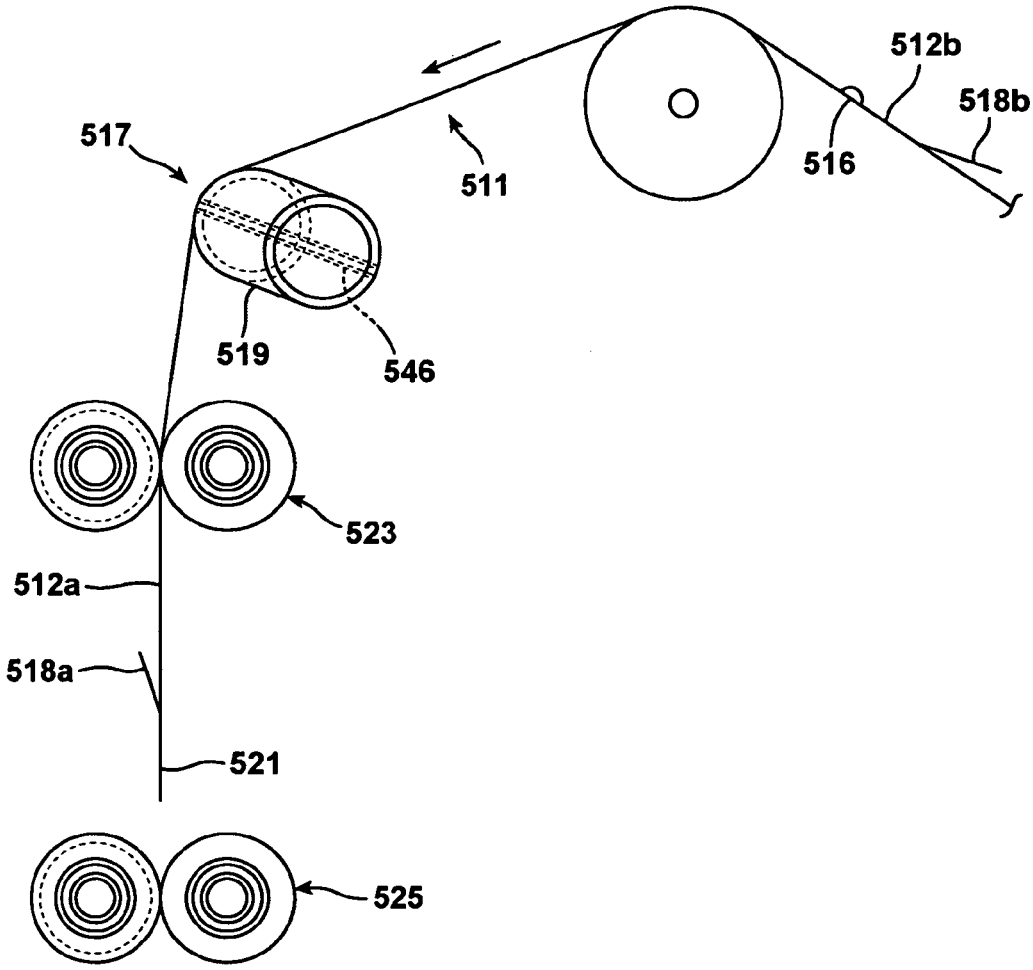
FIG. 12 is a schematic view of one embodiment of an apparatus and system in accordance with the invention.

One embodiment of the invention is shown schematically in FIG. 12. Conditions prior to cycle initiation include a web 511 of serrated bags 512 derived from a roll (not shown) with a serration 516, a free web end 521 of the leading bag 512*a* of web 511, tab 518*a* of bag 512*a*, and tab 518*b* of bag 512*b*. Tab 512*b* is useful for detecting and registering the location of bag 512*b*, as described herein. Those skilled in the art will appreciate, after a review of this disclosure, that the invention in this embodiment provides a plurality of bags 512 that each include a tab 518, where as the web of bags is advanced, serve to sequentially detect and register each bag in the system, thereby providing information to the system for separating each leading bag and advancing the web.

The web is advanced through a path such that the web advances through a pair of driven nip rolls 523, thus positioning the free web end 521 of web 511 between the pair of driven nip rolls 523, and a second pair of driven nip rolls 525. Nip rolls 525 are located down-stream of nip rolls 523. Nip rolls 523 are driven independently of nip rolls 525.

Activating nip rolls 523 and nip rolls 525 initiates a detecting and registering process cycle in which web 511 with free web end 521 is advanced toward nip rolls 525. This results in the subsequent entrainment of free web end 521 between nip rolls 525. During advancement of the web 511 and free web end 521 as just described, tab 518*b* passes over fixed roll 519 generating a registration signal establishing a know position of the tab 518*b*. Continued advancement of the web by a predetermined amount allows the tab 518*b* to be positioned to a known location. This capability is utilized to separate bags at serration 516 of known offset from tab 518*b* by advancing the web 511 until the serration 516 is positioned between nip rolls 523 and nip rolls 525, stopping nip rolls 523, allowing nip rollers 525 to tension, and braking the serration 516. Nip rolls 525 continue to rotate, clearing the separated bag from the nip rolls and concluding the cycle. A separated bag is thus produced that can be e.g. stored, moved to another part of the plant, or immediately loaded with a product such as a food product, e.g. a meat cut. The product can be loaded manually or mechanically by any suitable means otherwise known in the art.

EXAMPLE 2

A system like that of Example 1 is utilized in accordance with the invention, in an apparatus for selectively dispensing a web from a plurality of rolls of serrated bags, each roll of bags having a series of bags connected by transverse perforations, as disclosed in copending U.S. patent application Ser. No. 11/333,369 filed Jan. 17, 2006, entitled "Web Dispenser", and assigned to a common assignee with the present application. This application is incorporated herein by reference in its entirety.

In some packaging environments, such as the packaging of various cuts of fresh red meat, individual meat cuts can vary significantly in size. If pre-made bags are used to package these individual cuts, it may be necessary to have on hand bags of different dimensions, e.g. width and/or length, to accommodate the variability in product size.

It is desirable to provide a system and method for selectively dispensing a web from a plurality of rolls of serrated bags or lay-flat tubing, where the bags from any of the plurality of rolls can be registered so that they can be printed in a controlled fashion with any desired printing indicia, e.g. plant codes, product type, date of packaging, etc.

Figure 13:
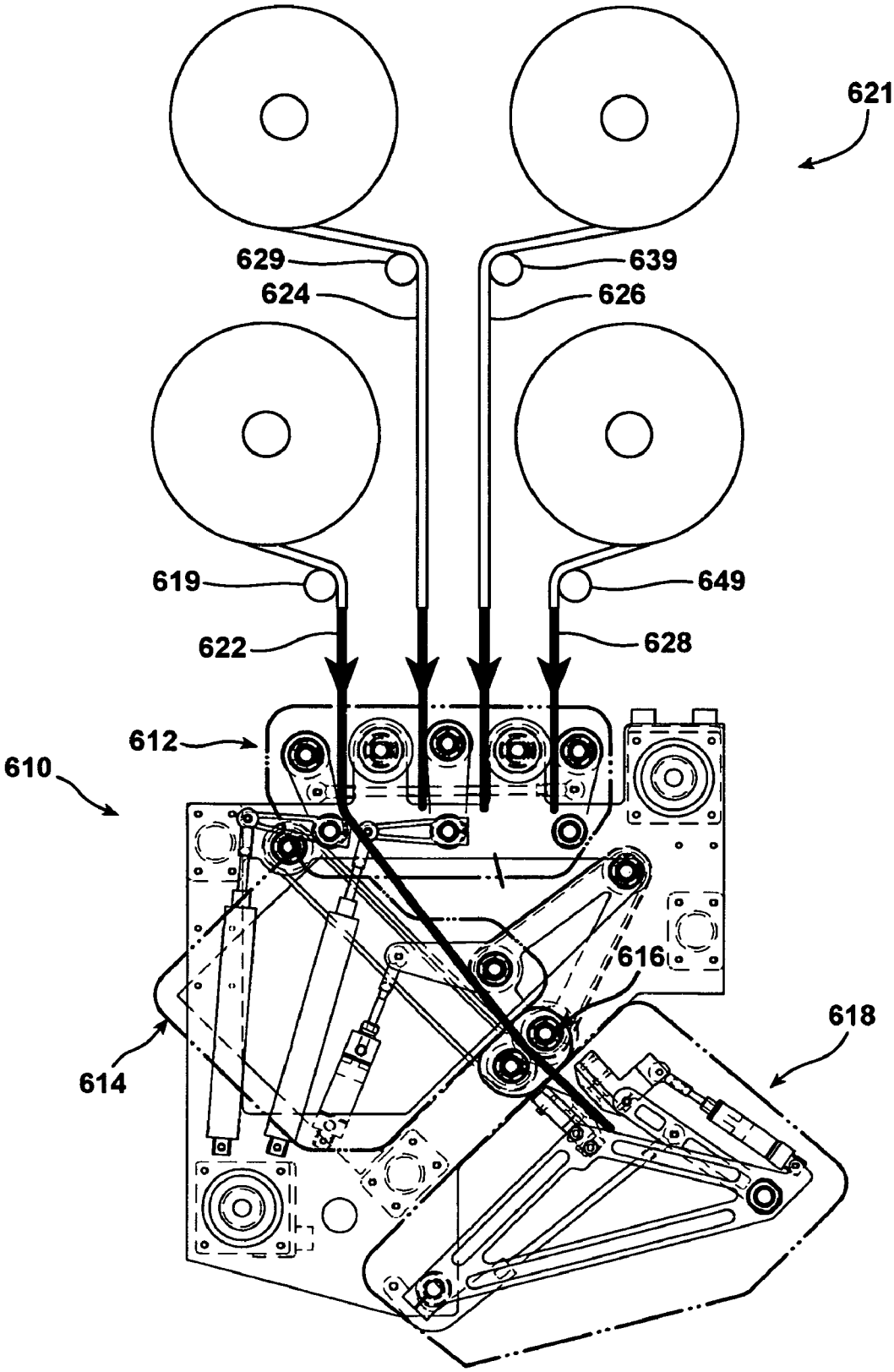
FIG. 13 is a schematic view of another embodiment of an apparatus and system in accordance with the invention.

FIG. 13 discloses an apparatus 610 for selectively dispensing a web from a plurality of rolls of serrated bags, each roll of bags having a series of bags connected by transverse perforations. The apparatus 610 includes a web selector 612, a web printer 614, a web driver 616, and a web transfer device 618.

The bags are characterized by the physical features of the bags described herein, e.g. in Example 1, i.e. a serration, a tab, and a transverse seal.

In one embodiment of the invention, up to four webs of serrated bags [web 622, web 624, web 626 and web 628], each web in the form of a roll of bags, are positioned in the web selector 612, with the free end of each web passing through a respective set of open nips. The open end of the lead bag of each web is at the free end of each respective web. In operation, the nip corresponding to the selected web is closed, and the nip is driven, thus feeding the web through the web printing device 614 (if the web is to be printed) with the free end of the web sequentially captured and driven by the nip of the web driver 616 and (if e.g. the web is to be advanced to a bag loader) positioned for engagement by the web transfer device 18.

To advance a specified web in any of the embodiments of the invention, the required nip is closed and a suitable drive motor or other motive device is activated in the proper direction.

A device of the type described herein, can be disposed at any suitable location down-stream of the web selector, to detect and register each bag. For example, any or all of the guide rolls 619, 629, 639, and 649 can function in a manner like roller 119, and can each provide a site at which a device like that of device 117 can be disposed to operate in the same manner as described herein for device 117. In this embodiment, web driver 616 functions like independently driven nip rolls 525 to differentially draw the web such that a lead bag separates from the web of bags.

In an alternative embodiment, the four (or more or less) webs of serrated bags [web 622, web 624, web 626 and web 628], each web in the form of a roll of bags, can be positioned in a horizontal array, instead of an array with two lower webs 622 and 628, and two upper webs 624 and 626 as shown in FIG. 13. The guide rolls in this alternative embodiment operate as disclosed hereinabove.

It is to be understood that variations of the present invention can be made without departing from the scope of the invention, which is not limited to the specific embodiments and examples disclosed herein, but extends to the claims presented below.

For example, although the tab of FIG. 4 is shown in a rectangular arrangement with right angles around the tab, the corners of the tab can be radiused to minimize the chance of unintended tearing of the bag.

Also, although the tab is shown herein with the attached portion of the tab (see for example reference line 118) arranged so that the open end of the tab is away from the respective serration, in an alternative embodiment the tab can be arranged so that the attached portion of the tab is arranged so that the open end of the tab is toward the respective serration. Thus, in FIG. 4 with this alternative arrangement, the reference line 118 would be further away from serration 114 than the mouth end of tab 116.

An intermediate approach is also an option, where the reference line 118 is not parallel to serration 114, but is at some angle, such as between 1 and 90°, to serration 114.

The tab of each bag is illustrated as being positioned at an equal distance from the first and second side of each bag, but some benefit can be obtained in accordance with the invention even if the tab is closer to one side than the other side. Those of skill in the art will appreciate, after a review of this disclosure, that the efficacy of the invention will be affected by the size and positioning of the tab vis-à-vis the bag sides, the configuration of device 117, the speed at which the web is advanced, and other factors. Multiple tabs distributed transversely or longitudinally across or along the bag, for example smaller tabs in the shape of "louvers" can be used, but some limit on efficacy, and spatial considerations with respect to the part of the bag that will be ultimately loaded with product, will need to be taken into consideration.

In an alternative embodiment, the tab on each bag can be initially positioned such that the hinge line of the tab is collinear with the serration of each respective bag. This alternative embodiment can utilize any of the geometries disclosed herein for the tab. However, this alternative embodiment may be more difficult to manufacture, because the through-cut or through-cuts made in each bag to produce the tab, will intersect the serration of each respective bag. This could complicate the cutting device used to make the through-cut or cuts and the serration. One way of dealing with this difficulty is to create the tab and serration of each bag in a two step or two stage process; first the serration is made, and then as a subsequent process step the through-cut or cuts are separately made. The opposite order can alternatively be employed, with the through-cut or cuts first made, then the serration.

What is claimed is:

1. A system for detecting and registering serrated bags comprising:

a) a web comprising a plurality of bags, the bags connected in an end-to-end arrangement, each bag comprising two walls, each bag of the plurality of bags comprising i) a first side;

ii) a second side;

iii) a first longitudinal end;

iv) a second longitudinal end;

v) a transverse seal;

vi) a serration disposed transversely across the bag, and extending from the first side to the second side; and vii) a tab cut through both walls of each bag, the tab being spaced from the first and second sides, and spaced from the first longitudinal end and second sides, and intermediate the first longitudinal end and second longitudinal end, the tab integrally connected to the bag at a portion of but less than the entire extent of the tab, and;

b) device for projecting a stream of air on each bag as the web passes a predetermined location, the device comprising a fixed roll, a source of compressed air, and an air nozzle disposed in the fixed roll, c) a first pair of nip rolls disposed downstream of the device;

d) a second pair of nip rolls disposed downstream of the first pair of nip rolls; and e) a detection device;

wherein the first and second pair of nip rolls are adapted to accommodate the web, and to drive at different speeds such that a lead bag is separated from the web; and wherein the detection device is adapted to detect a drop in air pressure as the tab of each bag passes the predetermined location, and to send a signal to the second pair of nip rolls to initiate separation of the lead bag from the web.

2. The system of claim 1 wherein the bags are patch bags.

3. The system of claim 1 wherein the tab of each bag comprises a rectangular through-cut that is attached to each bag on one side of the rectangle, and unattached to each bag on the other three sides of the rectangle.

* * * * *